US009188354B2

(12) United States Patent
Livchak et al.

(10) Patent No.: US 9,188,354 B2
(45) **Date of Patent: *Nov. 17, 2015**

(54) CONTROL OF EXHAUST SYSTEMS

(71) Applicant: OY HALTON GROUP LTD., Helsinki (FI)

(72) Inventors: Andrey Livchak, Bowling Green, KY (US); Derek W. Schrock, Bowling Green, KY (US); Rick Bagwell, Scottsville, KY (US); Darrin W. Beardslee, Bowling Green, KY (US)

(73) Assignee: OY HALTON GROUP LTD., Vantaa (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/656,491

(22) Filed: Mar. 12, 2015

(65) Prior Publication Data

US 2015/0241074 A1 Aug. 27, 2015

Related U.S. Application Data

(60) Continuation of application No. 13/763,167, filed on Feb. 8, 2013, now Pat. No. 9,011,215, which is a division of application No. 12/848,140, filed on Jul. 31, 2010, now Pat. No. 8,444,462, which is a (Continued)

(51) Int. Cl.

| | |
|---|---|
| ***F24F 7/00*** | (2006.01) |
| ***F24F 11/00*** | (2006.01) |
| ***F24F 13/00*** | (2006.01) |

(Continued)

(52) U.S. Cl.
CPC ..... *F24F 7/08* (2013.01); *B08B 15/023* (2013.01); *F24C 15/2042* (2013.01)

(58) Field of Classification Search
USPC ..... 454/67; 126/299 D, 299 R; 359/463
IPC ..... F24F 7/00,11/00, 13/00; F24C 15/20, F24C 15/2021, 15/2042; B08B 15/00, 15/02
See application file for complete search history.

(56) References Cited

U.S. PATENT DOCUMENTS

| | | |
|---|---|---|
| 2,743,529 A | 5/1956 | Hayes |
| 2,833,615 A | 5/1958 | Kollgaard |

(Continued)

FOREIGN PATENT DOCUMENTS

| | | |
|---|---|---|
| AU | 1138776 | 9/1977 |
| AU | 3400697 | 1/1998 |

(Continued)

OTHER PUBLICATIONS

Communication of Letter from Opponent, dated Apr. 4, 2012, in European Patent Application No. 20050775069 with English translation.

(Continued)

*Primary Examiner* — Steven B McAllister
*Assistant Examiner* — Helena Kosanovic
(74) *Attorney, Agent, or Firm* — Miles & Stockbridge P.C.; Michael A. Messina

(57) ABSTRACT

Exhaust capture and containment are enhanced by means of automatic or manual side skirts, a sensitive breach detector based on interference effects, a combination of vertical and horizontal edge jets, and/or corner jets that are directed to the center diagonally from corners. Associated control functions are described.

19 Claims, 12 Drawing Sheets

Related U.S. Application Data continuation of application No. 11/572,343, filed as application No. PCT/US2005/026378 on Jul. 25, 2005, now Pat. No. 8,038,515.

(60) Provisional application No. 60/590,889, filed on Jul. 23, 2004.

(51) Int. Cl.

| | |
|---|---|
| ***F24C 15/20*** | (2006.01) |
| ***G02B 27/22*** | (2006.01) |
| ***F24F 7/08*** | (2006.01) |
| ***B08B 15/02*** | (2006.01) |

(56) References Cited

U.S. PATENT DOCUMENTS

| | | | |
|---|---|---|---|
| 2,853,367 | A | 9/1958 | Karol et al. |
| 2,862,095 | A | 11/1958 | Scofield |
| 2,933,080 | A | 4/1960 | Adey |
| 3,332,676 | A | 7/1967 | Namy |
| 3,400,649 | A | 9/1968 | Jensen |
| 3,457,850 | A | 7/1969 | Sweet et al. |
| 3,513,766 | A | 5/1970 | Ahlrich |
| 3,536,457 | A | 10/1970 | Henderson |
| 3,829,285 | A | 8/1974 | Beck |
| 3,943,836 | A | 3/1976 | Kuechler |
| 3,952,640 | A | 4/1976 | Kuechler |
| 3,978,777 | A | 9/1976 | Nett |
| 4,043,319 | A | 8/1977 | Jensen |
| 4,047,519 | A | 9/1977 | Nett |
| 4,050,368 | A | 9/1977 | Eakes |
| 4,056,877 | A | 11/1977 | Kuechler |
| 4,085,736 | A | 4/1978 | Kuechler |
| 4,109,641 | A | 8/1978 | Hunzicker |
| 4,113,439 | A | 9/1978 | Ookubo et al. |
| 4,117,833 | A | 10/1978 | Mueller |
| 4,127,106 | A | 11/1978 | Jensen |
| 4,134,394 | A | 1/1979 | Otenbaker |
| 4,138,220 | A | 2/1979 | Davies et al. |
| 4,146,017 | A | 3/1979 | Overton, Jr. |
| 4,147,502 | A | 4/1979 | Milton, Jr. |
| 4,153,044 | A | 5/1979 | Nett |
| 4,211,154 | A | 7/1980 | Eakes |
| 4,213,947 | A | 7/1980 | Fremont et al. |
| 4,286,572 | A | 9/1981 | Searcy et al. |
| 4,346,692 | A | 8/1982 | McCauley |
| 4,373,507 | A | 2/1983 | Schwartz et al. |
| 4,467,782 | A | 8/1984 | Russell |
| 4,475,534 | A | 10/1984 | Moriarty |
| 4,483,316 | A | 11/1984 | Fritz et al. |
| 4,484,563 | A | 11/1984 | Fritz et al. |
| 4,497,242 | A | 2/1985 | Moyer |
| 4,553,992 | A | 11/1985 | Boissinot et al. |
| 4,556,046 | A | 12/1985 | Riffel et al. |
| 4,586,486 | A | 5/1986 | Kaufman |
| 4,617,909 | A | 10/1986 | Molitor |
| 4,655,194 | A | 4/1987 | Wooden |
| 4,706,553 | A | 11/1987 | Sharp et al. |
| 4,773,311 | A | 9/1988 | Sharp |
| 4,788,905 | A | 12/1988 | Von Kohorn |
| 4,811,724 | A | 3/1989 | Aalto et al. |
| 4,856,419 | A | 8/1989 | Imai |
| 4,872,892 | A | 10/1989 | Vartiainen et al. |
| 4,903,685 | A | 2/1990 | Melink |
| 4,903,894 | A | 2/1990 | Pellinen et al. |
| 4,944,283 | A | 7/1990 | Tsuchiya et al. |
| 4,944,285 | A | 7/1990 | Glassman |
| 5,042,453 | A | 8/1991 | Shellenberger |
| 5,050,581 | A | 9/1991 | Rohl-Hager et al. |
| 5,063,834 | A | 11/1991 | Aalto et al. |
| 5,215,075 | A | 6/1993 | Caridis et al. |
| 5,220,910 | A | 6/1993 | Aalto et al. |
| 5,251,608 | A | 10/1993 | Cote |
| 5,311,930 | A | 5/1994 | Bruenn |
| 5,312,296 | A | 5/1994 | Aalto et al. |
| 5,522,377 | A | 6/1996 | Fritz |
| 5,580,535 | A | 12/1996 | Hoke et al. |
| 5,622,100 | A | 4/1997 | King et al. |
| 5,657,744 | A | 8/1997 | Vianen |
| 5,716,268 | A | 2/1998 | Strongin et al. |
| 5,882,254 | A | 3/1999 | Jacob |
| 6,044,838 | A | 4/2000 | Deng |
| 6,058,929 | A | 5/2000 | Fritz |
| 6,089,970 | A | 7/2000 | Feustel |
| 6,170,480 | B1 | 1/2001 | Melink et al. |
| 6,173,710 | B1 | 1/2001 | Gibson et al. |
| 6,252,689 | B1 | 6/2001 | Sharp |
| 6,336,451 | B1 | 1/2002 | Rohl-Hager et al. |
| 6,347,626 | B1 | 2/2002 | Yi |
| 6,428,408 | B1 | 8/2002 | Bell et al. |
| 6,450,879 | B1 | 9/2002 | Suen |
| 6,752,144 | B1 | 6/2004 | Lee |
| 6,846,236 | B2 | 1/2005 | Gregoricka |
| 6,851,421 | B2 | 2/2005 | Livchak et al. |
| 6,869,468 | B2 | 3/2005 | Gibson |
| 6,878,195 | B2 | 4/2005 | Gibson |
| 6,899,095 | B2 | 5/2005 | Livchak et al. |
| 7,048,199 | B2 | 5/2006 | Melink |
| 7,147,168 | B1 | 12/2006 | Bagwell et al. |
| 7,318,771 | B2 | 1/2008 | Huang et al. |
| 7,364,094 | B2 | 4/2008 | Bagwell et al. |
| 2003/0146082 | A1 | 8/2003 | Gibson et al. |
| 2004/0011349 | A1 | 1/2004 | Livchak et al. |
| 2005/0115557 | A1 | 6/2005 | Meredith et al. |
| 2005/0229922 | A1 | 10/2005 | Magner et al. |
| 2005/0279845 | A1 | 12/2005 | Bagwell et al. |
| 2006/0032492 | A1 | 2/2006 | Bagwell et al. |
| 2006/0219235 | A1 | 10/2006 | Bagwell et al. |
| 2007/0015449 | A1 | 1/2007 | Livchak |
| 2007/0023349 | A1 | 2/2007 | Kyllonen et al. |
| 2007/0068509 | A1 | 3/2007 | Bagwell et al. |
| 2007/0184771 | A1 | 8/2007 | Fluhrer |
| 2007/0202791 | A1 | 8/2007 | Lee et al. |
| 2007/0272230 | A9 | 11/2007 | Meredith et al. |
| 2008/0045132 | A1 | 2/2008 | Livchak et al. |
| 2008/0207109 | A1 | 8/2008 | Bagwell et al. |
| 2008/0302247 | A1 | 12/2008 | Magner et al. |
| 2008/0308088 | A1 | 12/2008 | Livchak et al. |
| 2009/0093210 | A1 | 4/2009 | Livchak et al. |
| 2009/0199844 | A1 | 8/2009 | Meredith et al. |

FOREIGN PATENT DOCUMENTS

| | | |
|---|---|---|
| AU | 2933601 | 7/2001 |
| BE | 838829 | 6/1976 |
| CA | 1054430 | 5/1979 |
| CA | 1069749 | 1/1980 |
| CA | 1081030 | 7/1980 |
| CA | 2536332 | 3/2005 |
| CH | 682512 | 9/1993 |
| DE | 1679545 | 3/1971 |
| DE | 2607301 | 9/1976 |
| DE | 2659736 | 7/1977 |
| DE | 3144777 | 5/1983 |
| DE | 3519189 | 12/1986 |
| DE | 4120175 | 2/1992 |
| DE | 4114329 | 11/1992 |
| DE | 4203916 | 4/1993 |
| DE | 19613513 | 10/1997 |
| DE | 19911850 | 9/2000 |
| EP | 0401583 | 12/1990 |
| EP | 0753706 | 1/1997 |
| EP | 0881935 | 12/1998 |
| EP | 1250556 | 10/2002 |
| EP | 1637810 | 3/2006 |
| EP | 1778418 | 2/2007 |
| FI | 58971 | 1/1981 |
| FR | 2008451 | 1/1970 |
| FR | 2301778 | 9/1976 |
| FR | 2705766 | 2/1994 |
| GB | 1544445 | 4/1979 |
| GB | 2132335 | 7/1984 |
| HK | 1019417 | 2/2000 |

(56) References Cited

FOREIGN PATENT DOCUMENTS

| | | |
|---|---|---|
| JP | 51-132645 | 11/1976 |
| JP | 60-213753 | 10/1985 |
| JP | 63-091442 | 4/1988 |
| JP | 63-251741 | 10/1988 |
| JP | 10-084039 | 3/1989 |
| JP | 32-047937 | 11/1991 |
| JP | 40-000140 | 1/1992 |
| JP | 40-062347 | 2/1992 |
| JP | 40-068242 | 3/1992 |
| JP | 41-013143 | 4/1992 |
| JP | 52-048645 | 9/1993 |
| JP | 10-288371 | 10/1998 |
| JP | 11-514734 | 12/1999 |
| JP | 2000-081216 | 3/2000 |
| JP | 2002-089859 | 3/2002 |
| JP | 2003-519771 | 6/2003 |
| JP | 2003-269770 | 9/2003 |
| KR | 2006-000715 | 1/2006 |
| NL | 7601862 | 2/1976 |
| SE | 7602168 | 8/1976 |
| SE | 7904443 | 11/1980 |
| WO | 86/06154 | 10/1986 |
| WO | 97/48479 | 12/1997 |
| WO | 01/51857 | 7/2001 |
| WO | 01/84054 | 11/2001 |
| WO | 02/14728 | 2/2002 |
| WO | 02/14746 | 2/2002 |
| WO | 03/056252 | 7/2003 |
| WO | 2005/019736 | 3/2005 |
| WO | 2005/114059 | 12/2005 |
| WO | 2006/002190 | 1/2006 |
| WO | 2006/012628 | 2/2006 |
| WO | 2006/074420 | 7/2006 |
| WO | 2006/074425 | 7/2006 |
| WO | 2007/121461 | 10/2007 |
| WO | 2008/157418 | 12/2008 |
| WO | 2009/092077 | 7/2009 |
| WO | 2009/129539 | 10/2009 |

OTHER PUBLICATIONS

Communication of Notice of Opposition dated May 4, 2011 in European Patent Application No. 20050775069 with English translation of Statement of Grounds.

Faltsi-Saravelou et al., "Detailed Modeling of a Swirling Coal Flame," *Combustion Science and Technology*, 1997, 123:pp. 1-22.

Letter from Opponent, dated Dec. 20, 2012, in European Patent No. 1 778 418 with English translation.

Morsi et al., "An Investigation of Particle Trajectories in Two-Phase Flow Systems," *Journal of Fluid Mechanics*, 1972, 55:pp. 193-208.

Non-final Office Action, dated May 28, 2010, for U.S. Appl. No. 12/407,686.

Prosecution history of U.S. Appl. No. 07/010,277, now U.S. Pat. No. 4,811,724.

Summary for Gidaspow, D., *Multiphase Flow and Fluidization: Continuum and Kinetic Theory Descriptions*, Academic Press, 1994.

Summary for Lumley et al., *A First Course of Turbulence*, Massachusetts Institute of Technology, 1972.

Summons to Attend Oral Proceedings including Annex to Invitation, dated Aug. 2, 2012, for Opposition in European Patent Application No. 2005775069.

Translation of foreign patent document DE 4203919.

Written Opinion of the International Searching Authority for International Patent Application No. PCT/US05/26378.

Minutes of the Oral Proceedings of the Opposition Division, dated Feb. 18, 2013, in European Patent 1,778,418.

Interlocutory Decision in Opposition Proceedings, dated Feb. 18, 2013, in European U.S. Pat. No. 1,778,418.

Canadian Office Action for CA Application No. 2,828,718 dated Nov. 24, 2014.

CONTROL OF EXHAUST SYSTEMS

CROSS-REFERENCE TO RELATED APPLICATIONS

This application is a continuation of U.S. application Ser. No. 13/763,167 filed Feb. 8, 2013, which is a divisional of U.S. application Ser. No. 12/848,140, filed Jul. 31, 2010, which is a continuation of U.S. application Ser. No. 11/572,343, filed Jan. 19, 2007 (371(c) date of Aug. 29, 2008), which is a national stage application of International Application No. PCT/US05/26378, filed Jul. 25, 2005, which claims the benefit of U.S. Provisional Application No. 60/590,889, filed Jul. 23, 2004, all of which are hereby incorporated by reference herein in their entireties.

FIELD

The present invention relates generally to mechanisms for minimizing exhaust of conditioned air from occupied spaces such as commercial kitchens.

BACKGROUND

Exhaust hoods are used to remove air contaminants close to the source of generation located in a conditioned space. For example, one type of exhaust hoods, kitchen range hoods, creates suction zones directly above ranges, fryers, or other sources of air contamination. Exhaust hoods tend to waste energy because they must draw some air out of a conditioned space in order to insure that all the contaminants are removed. As a result, a perennial problem with exhaust hoods is minimizing the amount of conditioned air required to achieve total capture and containment of the contaminant stream.

Referring to FIG. 1A, a typical prior art exhaust hood 45 is located over a range 40 or other cooking source. The exhaust hood 45 has a recess 25 with at least one vent 20 (covered by a filter also indicated at 20) and an exhaust plenum 20 and duct 10 leading to an exhaust system (not shown) that draws off fumes 35. The exhaust system usually consists of external ductwork and one or more fans that pull air and contaminants out of a building and discharge them to a treatment facility or into the atmosphere. The recess 25 of the exhaust hood 45 plays an important role in capturing the contaminant because heat, as well as particulate and vapor contamination, are usually produced by the contaminant-producing processes. The heat causes its own thermal convection-driven flow or plume 35 which must be captured by the hood within its recess 25 while the contaminant is steadily drawn out of the hood. The recess creates a buffer zone to help insure that transient, or fluctuating, surges in the convection plume do not escape the steady exhaust flow through the vent.

It is desirable to draw off as little air from the conditioned space as possible. There are various problems that make it complicated to simply adjust the exhaust flow rate so that just enough air is withdrawn as needed to ensure all of the fumes are captured and drawn out by the hood. One problem is unpredictable cross drafts in the conditioned area. Employees might use local cooling fans or leave outside doors open. Or rapid movement of personnel during busy periods can create air movement. These drafts can shift the exhaust plume 35 sideways causing part of it to leave the suction zone of the hood allowing some of the fumes to escape into the occupied space.

Another problem is variations in the volume generation rate, the temperature and corresponding thermal convection forces, and phase change in the fumes. Generally exhaust hoods are operated at exhaust rates that correspond to the worst-case scenario. But this means they are overdesigned for most conditions. There is an on-going need for mechanisms for minimizing the exhaust rate while maintaining capture and containment of fumes.

One means for reducing the effect of cross-drafts is the use of side skirts 30 as shown in FIG. 1B. Side skirts 30, which are simple metal plates, may be affixed at the ends of an exhaust hood 46 as illustrated allowing workers to access a cooking appliance 40 from a front edge 36 of the appliance 40 without interference from the skirts 30. The skirts 30 reduce the sensitivity of the plume of fumes 35 to cross-drafts by simply blocking cross-drafts. Although only one is shown, a skirt 30 is implied on an opposite side of the hood 46 perpendicular to the line of sight of the elevation drawing.

FIGS. 1A and 1B illustrate hoods ("backshelf") that are normally located against a wall. Another type of hood is illustrated in FIG. 2 which is called a canopy hood 60. This type of hood can have mirror image exhaust outlets as indicated at 21 (with filters also indicated at 20) or it can have an asymmetrical configuration. The canopy style hood 60 allows workers 5 to approach multiple sides of an appliance 41 such as one or more ranges. The canopy style hood is particularly susceptible to cross-drafts because of its open design.

In addition to minimizing the exhaust rate while providing capture and containment, there are many opportunities in commercial kitchens to recycle otherwise wasted energy expended on conditioning air, such as using transfer air from a dining area to ventilate a kitchen where exhaust flow rates and outdoor air ventilation rates are high. In such systems, the space conditioning or heating, ventilating and air-conditioning (HVAC) systems are responsible for the consumption of vast amounts of energy. Much of the expended energy can be saved through the use of sophisticated control systems that have been available for years. In large buildings, the cost of sophisticated control systems can be justified by the energy savings, but in smaller systems, the capital investment is harder to justify. One issue is that sophisticated controls are pricey and in smaller systems, the costs of sophisticated controls don't scale favorably leading to long payback periods for the cost of an incremental increase in quality. Thus, complex control systems are usually not economically justified in systems that do not consume a lot of energy. It happens that food preparation/dining establishments are heavy energy users, but because of the low rate of success of new restaurants, investors justify capital expenditures based on very short payback periods.

Less sophisticated control systems tend to use energy where and when it is not required. So they waste energy. But less sophisticated systems exact a further penalty in not providing adequate control, including discomfort, unhealthy air, and lost patronage and profits and other liabilities that may result. Better control systems minimize energy consumption and maintain ideal conditions by taking more information into account and using that information to better effect.

Among the high energy-consuming food preparation/dining establishments such as restaurants are other public eating establishments such as hotels, conference centers, and catering halls. Much of the energy in such establishments is wasted due to poor control and waste of otherwise recoverable energy. There are many publications discussing how to optimize the performance of HVAC systems of such food preparation/dining establishments. Proposals have included systems using traditional control techniques, such as proportional, integral, differential (PID) feedback loops for precise control of various air conditioning systems combined with proposals for saving energy by careful calculation of required exhaust rates, precise sizing of equipment, providing for transfer of air from zones where air is exhausted such as bathrooms and kitchens to help meet the ventilation requirements with less make-up air, and various specific tactics for recovering otherwise lost energy through energy recovery devices and systems.

Although there has been considerable discussion of these energy conservation methods in the literature, they have had only incremental impact on prevailing practices due to the relatively long payback for their implementation. Most installed systems are well behind the state of the art.

There are other barriers to the widespread adoption of improved control strategies in addition to the scale economies that disfavor smaller systems. For example, there is an understandable skepticism about paying for something when the benefits cannot be clearly measured. For example, how does a purchaser of a brand new building with an expensive energy system know what the energy savings are? To what benchmark does one compare the performance? The benefits are not often tangible or perhaps even certain. What about the problem of a system's complexity interfering with a building operator's sense of control? A highly automated system can give users the sense that they cannot or do not know how to make adjustments appropriately. There may also be the risk, in complex control systems, of unintended goal states being reached due to software errors. Certainly, there is a perennial need to reduce the costs and improve performance of control systems. The embodiments described below present solutions to these and other problems relating to HVAC systems, particularly in the area of commercial kitchen ventilation.

DETAILED DESCRIPTION

The following US patent applications are hereby incorporated by reference as if set forth in their entireties herein: U.S. patent application Ser. No. 10/344,505, entitled "Device and Method for Controlling/Balancing Fluid Flow-Volume Rate in Flow Channels," filed Aug. 11, 2003; U.S. patent application Ser. No. 10/168,815, entitled "Exhaust Hood with Air Curtain to Enhance Capture and Containment," filed May 5, 2003; and U.S. patent application Ser. No. 10/638,754, entitled "Zone Control of Space Conditioning Systems with Varied Uses," filed Aug. 11, 2003.

Figure 1A:
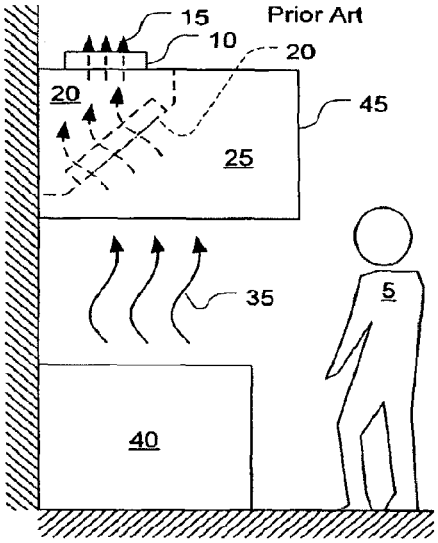
FIG. 1A is a side view illustration of a prior art backshelf hood.
Figure 1B:
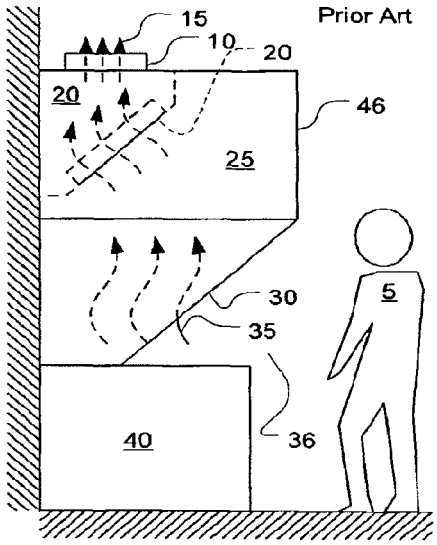
FIG. 1B is a side view illustration of a prior art backshelf hood with side skirts.
Figure 2:
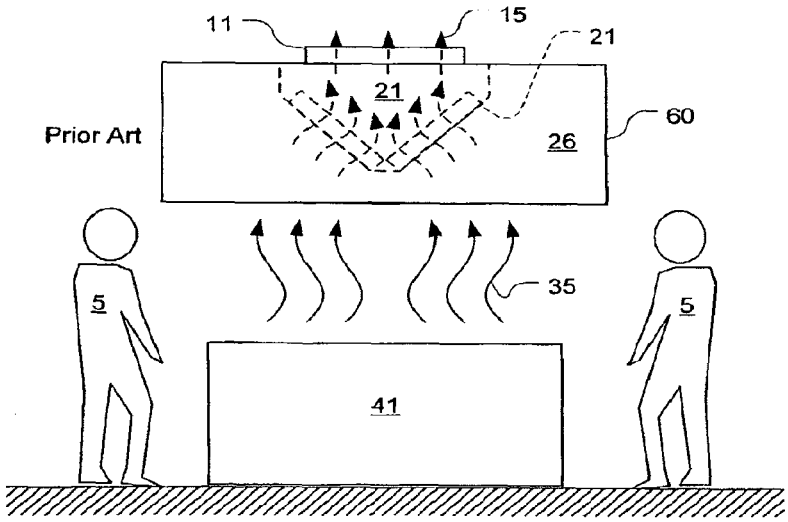
FIG. 2 is a side view illustration of a prior art canopy style hood with an island appliance.
Figure 3A:
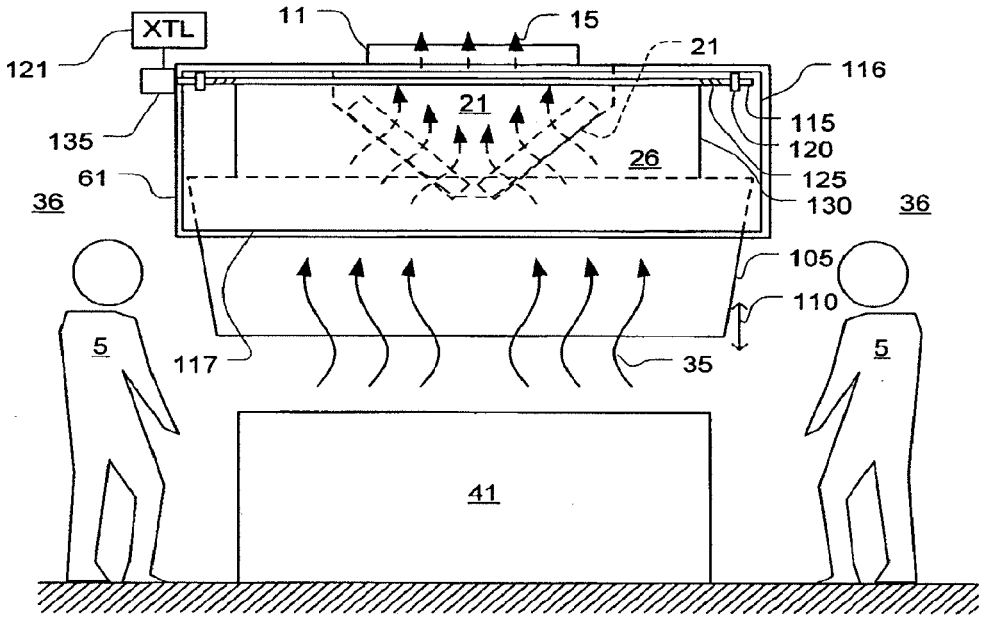
FIG. 3A is a side view illustration of a canopy style hood with adjustable side skirts according to a first inventive embodiment.

FIG. 3A is a side view illustration of a canopy style hood 61 with adjustable side skirts 105 according to a first inventive embodiment. Fumes 35 rise from a cooking appliance 41 into a suction zone of the hood 61. The fumes are drawn, along with air from the surrounding conditioned space 36 the hood 61 occupies, through exhaust vents and grease filters indicated at 21 by an exhaust fan (not shown in the present drawing) connected to draw through an exhaust duct 11. An exhaust stream 15 is then forced away from the occupied space.

At one or more sides of the exhaust hood 61 are movable side skirts 105 which may be raised or lowered by means of a manual or motor drive 135. The manual or motor drive 135 rotates a shaft 115 which spools and unspools a pair of support wires 130 to raise and lower the side skirts 105. The side skirts 61 and spool 125, as well as bearings 120 and the wires 130, may be hidden inside a housing 116 with an open bottom 117. In a preferred embodiment, the manual or motor drive 135 is a motor drive controlled by a controller 121 which controls the position of the side skirts 105.

Although the above and other embodiments of the invention described below are discussed in terms of a kitchen application, it will be readily apparent to those of skill in the art that the same devices and features may be applied in other contexts. For example, industrial buildings such as factories frequently contain large numbers of exhaust hoods which exhaust fumes in a manner that are very similar to what obtains in a commercial kitchen environment. It should be apparent from the present specification how minor adjustments, such as raising or lowering the hood, adjusting proportions using conventional design criteria, and other such changes can be used to adapt the invention to other applications. The inventor(s) of the instant patent application consider these to be well within the scope of the claims below unless explicitly excluded.

Figure 3B:
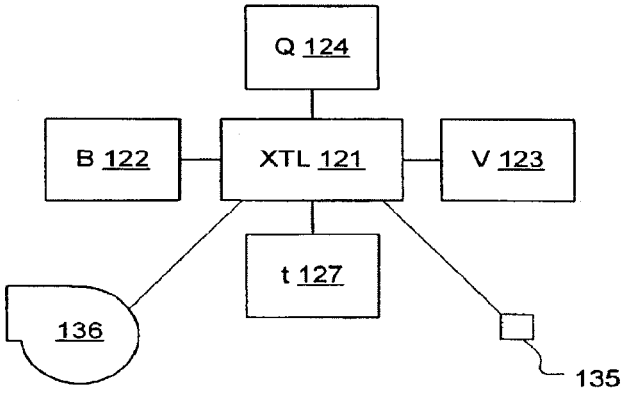
FIG. 3B is a schematic illustration of a control system for the embodiment of FIG. 3A as well as other embodiments.

FIG. 3B is a schematic illustration of a control system for the embodiment of FIG. 3A as well as other embodiments. The controller 121 may control the side skirts automatically in response to incipient breach, for example, as described in the US Patent Application, "Device and Method for Controlling/Balancing Fluid Flow-Volume Rate in Flow Channels," incorporated by reference above. To that end, an incipient breach sensor 122 may be mounted near a point where fumes may escape due to a failure of capture and containment. Examples of sensors that may be employed in that capacity are discussed below and include humidity, temperature, chemical, flow, and opacity sensors.

Another sensor input that may be used to control the position of the side skirts 105 is one that indicates a current load 124. For example, a temperature sensor within the hood 61, a fuel flow indicator, or CO or CO2 monitor within the hood may indicate the load. When either of incipient breach or current load indicates a failure or threat to full capture and containment, the side skirts 105 may be lowered. This may be done in a progressive manner in proportion to the load. In the case of incipient breach, it may be done by means of an integral of the direct signal from the incipient breach sensor 122. Of course, any of the above sensors (or others discussed below) may be used in combination to provide greater control, as well as individually.

A draft sensor 123 such as a velocimeter or low level pressure sensor or other changes that may indicate cross currents that can disrupt the flow of fumes into the hood. These are precisely the conditions that side skirts 105 are particularly adapted to control. Suitable transducers are known such as those used for making low level velocities and pressures. These may be located near the hood 61 to give a general indication of cross-currents. When cross-currents appear, the side skirts 105 may be lowered. Preferably the signals or the controller 121 is operative to provide a stable output control signal as by integrating the input signal or by other means for preventing rapid cycling, which would be unsuitable for the raising and lowering of the side skirts 105.

The controller 121 may also control the side skirts 105 by time of day. For example, the skirts 105 may be lowered during warm-up periods when a grill is being heated up in preparation for an expected lunchtime peak load. The controller 121 may also control an exhaust fan 136 to control an exhaust flow rate in addition to controlling the side skirts 105 so that during periods when unhindered access to a fume source, such as a grill, is required, the side skirts 105 may be raised and the exhaust flow may be increased to compensate for the loss of protection otherwise offered by the side skirts 105. The controller may be configured to execute an empirical algorithm that trades off the side skirt 105 elevation against exhaust flow rate. Alternatively, side skirt 105 elevation and exhaust rate may be controlled in a master-slave manner where one variable is established, such as the side skirt 105 elevation in response to time of day, and exhaust rate is controlled in response to one or a mix of the other sensors 124, 123, 127, and/or 122.

Figure 4:
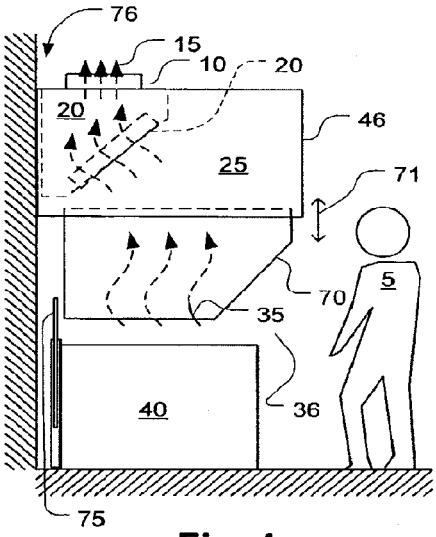
FIG. 4 is a side view illustration of a backshelf hood with a fire gap and movable side skirts and a movable back skirt.

FIG. 4 is a side view illustration of a backshelf hood 46 with a fire safety gap 76 and movable side skirts 70 and a movable back skirt 75. The side skirts 70 may be one or both sides and may be manually moved or automatically driven as discussed above with reference to FIGS. 3A and 3B. The movable back skirt 75 is located behind the appliance 40 and is raised to block the movement of fumes due to cross drafts. The back skirt could as easily be attached to the hood 46 and lowered into position.

Note that any of the skirts discussed above and below may be configured based on a variety of known mechanical devices. For example, a skirt may hinged and pivoted into position. It may be have multiple segments such that is unfolds or unrolls like some metal garage doors.

Figure 5:
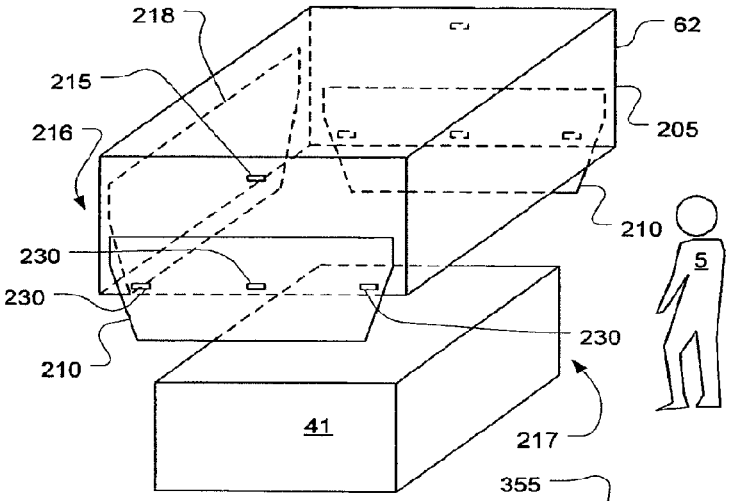
FIG. 5 is a side view illustration of a canopy style hood with adjustable side skirts according to a second inventive embodiment.

FIG. 5 is a side view illustration of a canopy style hood 62 with adjustable side skirts 210 according to a another inventive embodiment. The side skirts 210 may be manually or automatically movable. There may be two, one at either of two ends of the hood 62 or there may be more or less on adjacent sides of the hood 62, such as a back side 216. In some situations where most of the access required to the appliances can be accommodated on a front side 217 of the hood 62, it may be feasible to lower a rear skirt 218.

Note that it is unnecessary to discuss the location and type of drives to be used and the precise details of manual and automatic skirts because they are well within the ken of machine design. For the same reason, as here, examples of suitable drive mechanisms are not repeated in the drawings.

Also shown in FIG. 5 is a suitable location for one or more proximity control sensors 230 that be used in the present or other embodiments. Proximity sensors may be used to give an indication of whether access to a corresponding side of the appliance 41 is required, in a manner not unlike that of an automatic door of a public building. One or more proximity sensors 230 may be used to raise and lower the side skirts.

Figure 6:
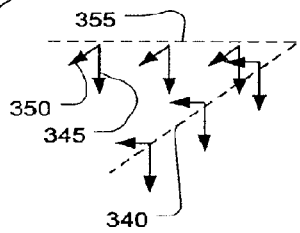
FIG. 6 is a figurative representation of a combination of horizontal and vertical jets to be generated at the edge of a hood according to an inventive embodiment.

As taught in the patent application for "Exhaust Hood with Air Curtain to Enhance Capture and Containment," incorporated by reference above, a virtual barrier may be generated to help block cross-drafts by means of a curtain jet located at an edge of the hood. FIG. 6 is a figurative representation of a combination of horizontal and vertical jets to be generated at the edge of a hood according to an inventive embodiment which has been shown by experiment to be advantageous in terms of minimizing the exhaust flow required to obtain full capture and containment. In a preferred configuration, the horizontal and vertical jets are made by forming holes in a plenum, for example holes of about 3-6 mm diameter with a regular spacing so that the individual jets coalesce some distance away from the openings to form a single planar jet. The initial velocities of the horizontal jets are preferably between 2 and 3.5 times the initial velocities of the vertical jets, the initial velocity in this case being the point at which individual jets coalesce into a single planar jet.

Figure 7B:
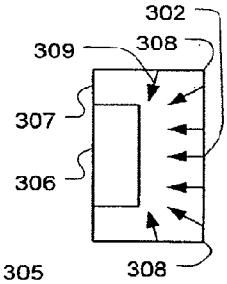
FIG. 7B is a plan view of a typical hood showing a central location of the exhaust vent.
Figure 7A:
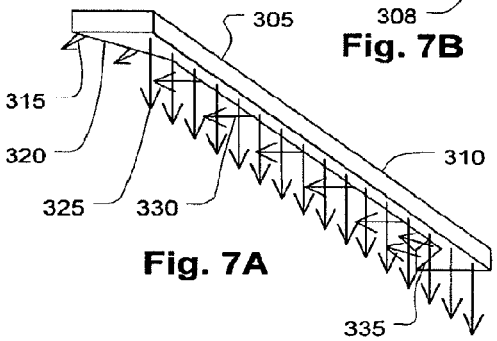
FIG. 7A is a figurative illustration of a plenum configured to generate the vertical and horizontal jets with diagonal horizontal jets at ends of the plenum according to an inventive embodiment.

FIG. 7A is a figurative illustration of a plenum 310 configured to generate the vertical 325 and horizontal 330 jets with diagonal horizontal jets 315 at ends of the plenum 310 according to an inventive embodiment. Referring momentarily to FIG. 7B, most hoods 307 have an exhaust vent 306 within the hood 307 recess that is centrally located so that even if the hood has a large aspect ratio, at the ends, horizontal jets 309 (330 in FIG. 7A) are more effective at capturing exhaust if they are directed toward the center of the hood near the ends 308 of the long sides 302. Thus, in a preferred, configuration of the plenum 310, the ends 325 of the plenum have an angled structure 320 to project the horizontal jets diagonally inwardly as indicated at 315.

Figure 8A:
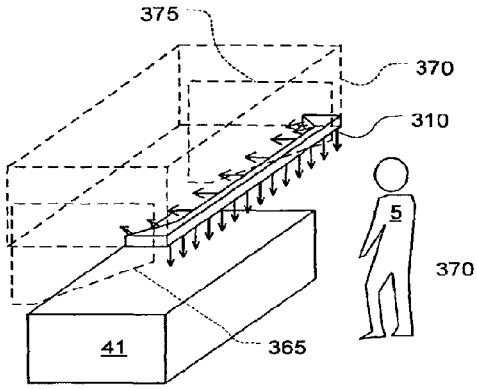
FIGS. 8A and 8B illustrate the position of the plenum of FIG. 7 as would be installed in a wall-type (backshelf) hood as well as a combination of the horizontal and vertical jets with side skirts according to at least one inventive embodiment.
Figure 8B:
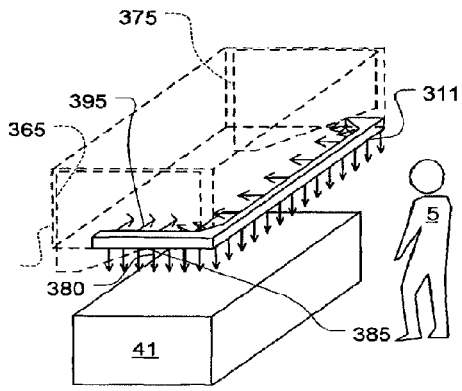
Figure 8C:
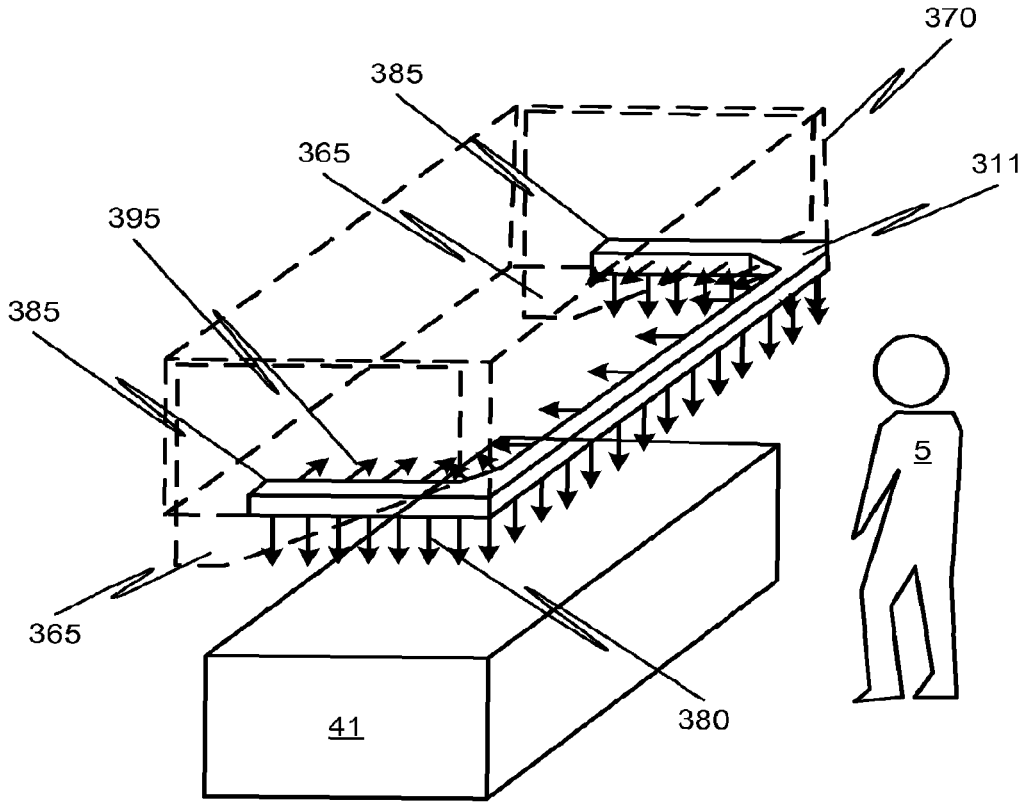
FIG. 8C illustrates a wall-type (backshelf) hood with a combination of horizontal and vertical jets, according to an embodiment of the disclosed subject matter.

FIGS. 8A and 8B illustrate the position of the plenum 310 of FIG. 7A as would be installed in a wall-type (backshelf) hood 370 as well as a combination of the horizontal and vertical jets with side skirts 365 according to another inventive embodiment. This illustration shows how the plenum 310 of FIG. 7B may be mounted in a backshelf hood 370. In addition, the figure shows the combination of the vertical and horizontal jets and the side skirts 365. In such a combination, the velocity of the vertical and horizontal jets may be reduced when the side skirts 365 are lowered and increased when the side skirts are raised. Note that although not shown in an individual drawing, the same control feature may be applied to horizontal-only jets and vertical-only jets which are discussed in "Exhaust Hood with Air Curtain to Enhance Capture and Containment," incorporated by reference above. FIG. 8A shows the side skirts 365 in a lowered position and FIG. 8B shows the side skirts 365 in a raised position. Note that the plenum 310 may be made integral to the hood and also that a similar mounting may be provided for canopy style hoods. FIG. 8B also shows an alternative plenum configuration 311 with a straight return 385 on one side which generates vertical 380 and horizontal 395 jets along a side of the hood 370. The return leg 385, although shown on one end only, may be used on both ends, for example, as shown in FIG. 8C, and is also applicable to canopy style hoods.

Figure 9A:
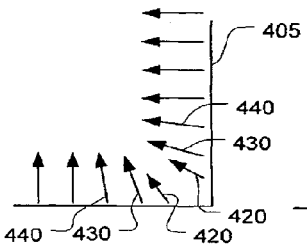
FIGS. 9A-9C illustrate various ways of wrapping a series of horizontal jets around a corner to avoid end effects according to inventive embodiment(s).
Figure 9B:
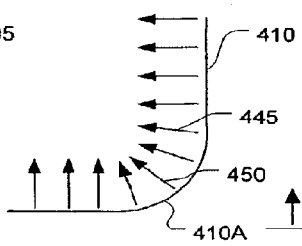
Figure 9C:
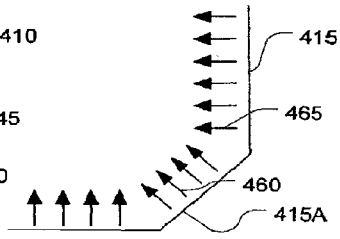
Figure 9D:
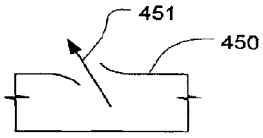
FIG. 9D illustrates a way of creating a hole in a plenum that redirects a small jet without a separate fixture by warping the wall of the plenum.

FIGS. 9A-9C illustrate various ways of wrapping a series of horizontal jets around a corner to avoid end effects according to inventive embodiment(s). These alternative arrangements may be provided by shaping a suitable plenum as indicated by the respective profile 405, 410, 415. Directional orifices may be created to direct flow inwardly at a corner without introducing a beveled portion 415A or curved portion 410A as indicated by arrows 420. FIG. 9D illustrates a way of creating a directional orifice in a plenum 450 to direct a small jet 451 at an angle with respect to the wall of the plenum 450. This may done by warping the wall of the plenum 450 as indicated or by other means as disclosed in the references incorporated herein.

Figure 10:
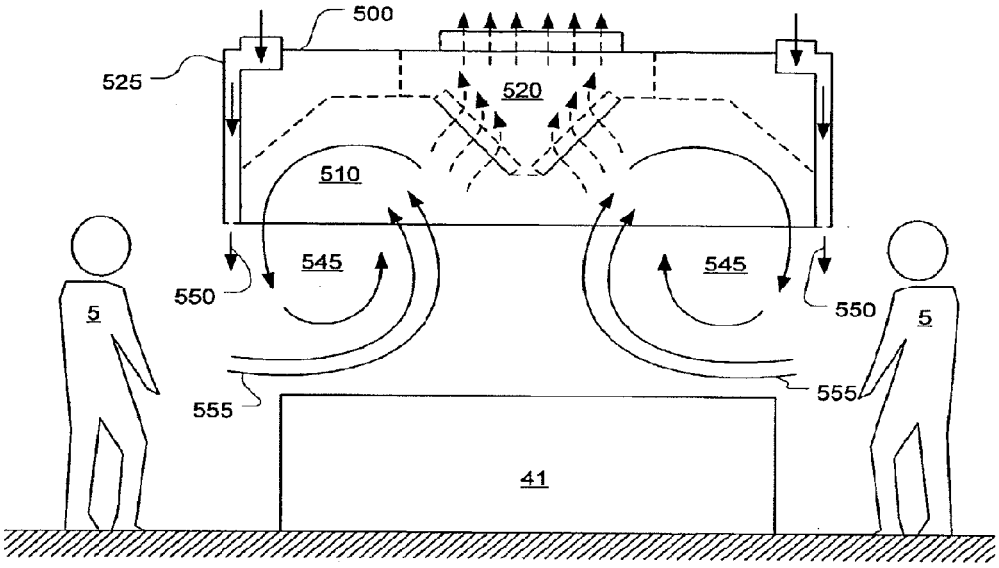
FIG. 10 illustrates a canopy-style hood with vertical jets and a configuration that provides a vertical flow pattern that is subject to an end effects problem.

FIG. 10 illustrates a canopy-style hood 500 with vertical jets 550 and a configuration that provides a vortical flow pattern 545 that is subject to an end effects problem. The end effects problem is that where the vortices meet in corners, the flow vertical flow pattern is disrupted. As discussed in "Exhaust Hood with Air Curtain to Enhance Capture and Containment," incorporated by reference above, the vortical flow pattern 545 works with the air curtain 550 to help ensure that fluctuating fume loads can be contained by a low average exhaust rate. But the vortex cannot make sharp right-angle bends so the quasi-stable flow is disrupted at the corners of the hood.

Figure 11A:
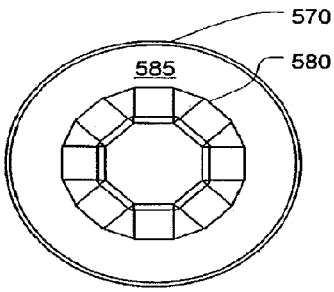
FIGS. 11A and 11B illustrate configurations of a canopy hood that reduce or eliminate the end effect problem of the configuration of FIG. 10.
Figure 11B:
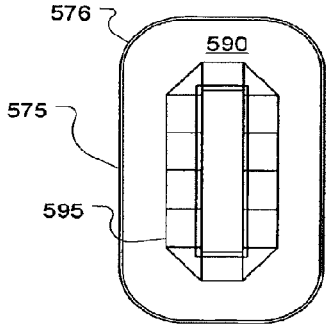

FIGS. 11A and 11B illustrate configurations of a canopy hood that reduce or eliminate the end effect problem of the configuration of FIG. 10. Referring to FIGS. 11A and 11B, a round hood 570 or one with rounded corners 576 reduces the three-dimensional effects that can break down the stable vortex flow 545. In either shape, a toroidal vortex may be established in a curved recess 585 or 590 with the vertical jets following the rounded edge of the hood. Thus the section view of FIG. 10 would be roughly representative of any arbitrary slice through the hoods 576, 570 shown in plan view in FIGS. 11A and 11B.

The figures also illustrate filter banks 580 and 595. It may be impractical to make the filter banks 580 and 595 rounded, but they may be piecewise rounded as shown.

Figure 12:
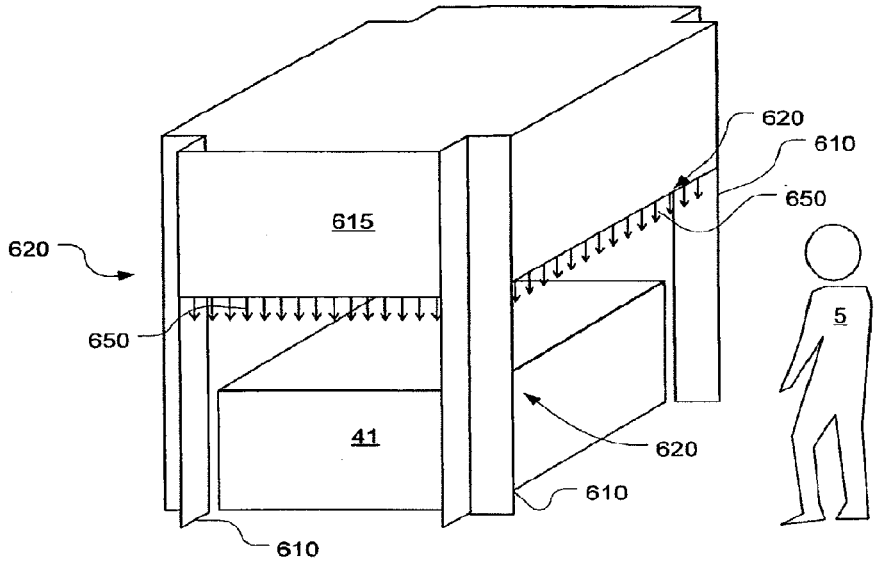
FIG. 12 illustrates a configuration of a canopy hood that reduces the end effect problem of the configuration of FIG. 10 by supporting the canopy using columns at the corners that are shaped to eliminate interactions at the ends of the straight portions of the hood.

FIG. 12 illustrates a configuration of a canopy hood 615 that reduces the end effect problem of the configuration of FIG. 10 by supporting the canopy using columns 610 at the corners that are shaped to eliminate interactions at the ends of the straight portions 620 of the hood 615. Vertical jets 650 do not wrap around the hood 615 and neither does the internal vortex (not illustrated) since there are separate vortices along each edge bounded by the columns 610.

Figure 13A:
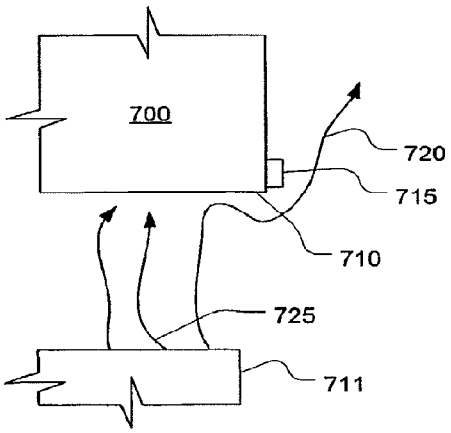
FIG. 13A illustrates a hood configuration with a sensor that uses incipient breach control to minimize flow volume while providing capture and containment.

FIG. 13A illustrates a hood configuration with a sensor that uses incipient breach control to minimize flow volume while providing capture and containment. Incipient breach control is discussed in "Device and Method for Controlling/Balancing Fluid Flow-Volume Rate in Flow Channels," incorporated by reference above. Briefly, when fumes 725 rise from a source appliance 711, and there is a lack of sufficient exhaust flow or there is a cross-draft, part of the fumes may escape as indicated by arrow 720. A sensor located at 715 or nearby position may detect the temperature, density, or other detectable feature of the fumes to indicate the breach. The indication may be used by a controller to control exhaust flow as discussed in the above patent or others such as U.S. Pat. No. 6,170,480 entitled "Commercial Kitchen Exhaust System," which is hereby incorporated by reference as if fully set forth herein in its entirety.

Prior applications have discussed optical, temperature, opacity, audio, and flow rate sensors. In the present application we propose that chemical sensors such as carbon monoxide, carbon dioxide, and humidity may be used for breach detection. In addition, as shown in FIG. 13B, an interferometric device may also be employed to detect an associated change, or fluctuation, in index of refraction due to escape of fumes.

Figure 13B:
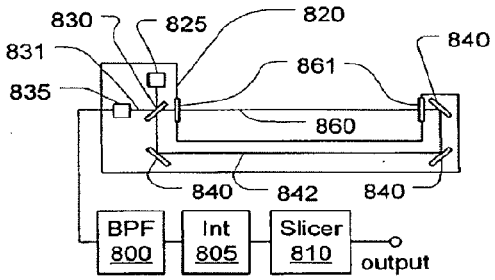
FIG. 13B illustrates an interferometric breach detector for use with the embodiment of FIG. 13A and other applications.

Referring to FIG. 13B, a coherent light source 825 such as a laser diode emits a beam that is split by a beam splitter 830 to form two beams that are incident on a photo detector 835. A reference beam 831 travels directly to the detector 835. A sample beam 842 is guided by mirrors 840 to a sample path 860 that is open to the flow of ambient air or fumes. The reference and sample beams 831 and 842 interfere in the beam splitter, affecting the intensity of the light falling on the detector 835. The composition and temperature of the fumes creates fluctuations in the effective path length of the sample path 860 due to a fluctuating field of varying index of refraction. This in turn causes the phase difference between the reference 831 and sample 860 beams to vary causing a variation in intensity at the detector 835.

The direct output of the detector 835 may be passed through a bandpass filter 800, an integrator 805, and a slicer (threshold detector) 810 to provide a suitable output signal. The reason a bandpass filter may be useful is to eliminate slowly varying components that could not be a result of fumes such as a person leaning against the detector, as well as changes too rapid to be characteristic of the turbulent flow field associated with a thermal plume or draft, such as motor vibrations. An integrator ensures that the momentary transients do not create false signals and the slicer provides a threshold level.

It will be understood that for sample paths 860 that are large, i.e., many wavelengths long, many rapid changes in the detector 835 output may occur as the result of changes in the temperature or mix of gases due to the change in the speed of light through the path 860. Thus, an alternative way of detecting changes is to count the number of fringes detected (using for example a one-shot circuit to form pulse edges) and to generate a signal corresponding to the rate of pulses. A high rate of pulses indicates a correspondingly large change in the speed of light in the sample path. Large changes are associated with turbulent mixing and the escape of heat and/or gases from the cooking process.

Figure 13C:
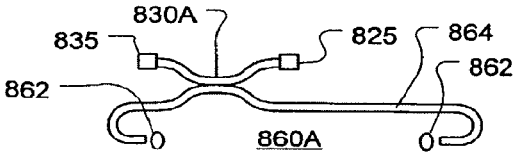
FIG. 13C illustrates an interferometer using a directional coupler and optical waveguides instead of beam splitter and mirrors.

Referring to FIG. 13C, an alternative embodiment of a detector uses a directional coupler 830A instead of a beam splitter as in the previous embodiment. Rather than mirrors, a waveguide 864 is used to form a sample path 860A. A light source 825 sends light into the direction coupler 830A which is split with one component going to the detector 835 and the other passing through the sample path 860A and back to the direction coupler 830A. Fluctuations in phase of the return light from the sample path 860A cause variations in the intensity incident on the detector 835 as in the previous embodiment.

Preferably, the interferometric detector should allow gases to pass through the measurement beam without being affected unduly by viscous forces. If the sample path is confined in a narrow channel, viscous forces will dominate and the detector will be slow to respond. This may be desirable. For example, it may avoid false positives resulting when a transient flow of gas contacts the sensor but does not remain present for a sufficiently long time or does not have sufficient concentration of contaminant to diffuse enough gas or heat into the sample gap. Also, if the sample path is too long the signal might be diminished due to an averaging effect, where the average of the speed of light in the same path remains relatively constant even though at a given point, the speed varies a great deal to the variation in the gas content or properties. These effects vary with the application and will involve some experimentation. Different detectors may be provided for different applications, for example, a hood for a grill versus one for a steam table.

To control based on breach detection, a variety of techniques can be used. Pure feedback control may be accomplished by slowly lowering the speed of a variable speed exhaust fan until a threshold degree of breach is indicated. The threshold may be, for example, the specified minimum frequency of pulses from the one-shot configuration described above sustained over a minimum period of time. In response to the breach, the speed may be increased by a predefined amount and the process of lowering the speed repeated. A more refined approach may be a predictive or model-based technique in which other factors, besides breach, are used to model the fume generation process as described in the present application and in U.S. patent application Ser. No. 10/638,754 incorporated by reference above. The technique for feedback control may follow those outlined in U.S. Pat. No. 6,170,480 also incorporated by reference above.

Figure 13D:
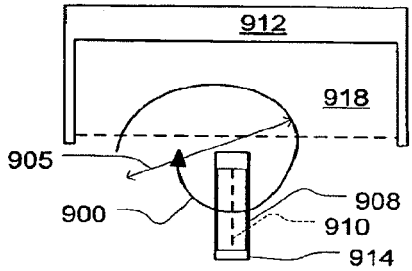
FIG. 13D illustrates some mechanical issues concerning measurements that depend on the structure of turbulence.

It may be preferable for the gap to be longer than the length scale of the temperature (or species, since the fumes may be mixed with surrounding air) fluctuations to provide a distinct signature for the signal if the gap would substantially impede the flow. Otherwise, the transport of temperature and species through the sample beam would be governed primarily by molecular diffusion making the variations slow, for example, if the sample beam were only exposed in a narrow opening. However, in some applications of a detector this may be desirable, but such applications are likely removed from typical commercial kitchen application. Referring to FIG. 13D, a microscale eddy is figuratively shown at 900. The structure of the detector may provide a space 918 that is large relative to the smallest substantial turbulent microscale as indicated at 912. Alternatively, the structure of the detector may be smaller than the microscale, but thin and short as indicated at 914 in which case viscous forces may not impede greatly the variation of the constituent gases in the sample path 910 due to turbulent convection.

Figure 14:
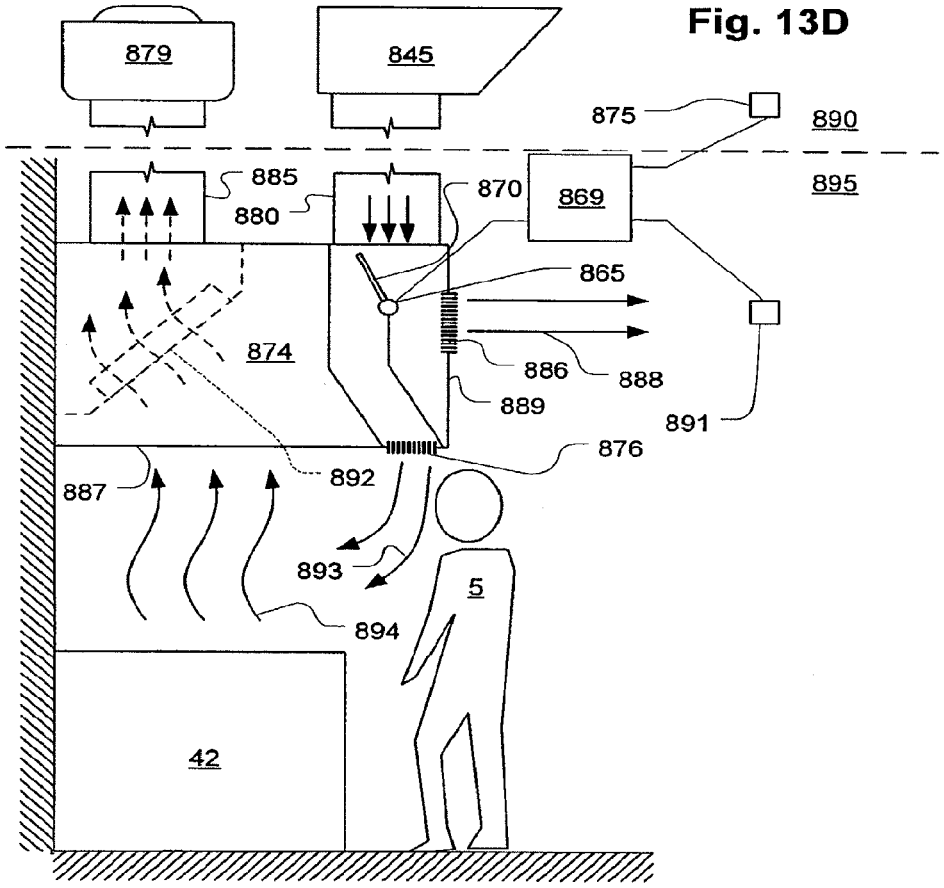
FIG. 14 illustrates a combination make-up air discharge register and hood combination with a control mechanism for apportioning flow between room-mixing discharge and short-circuit discharge flows.

FIG. 14 illustrates a combination make-up air discharge register/hood combination 887 with a control mechanism 869 and 870 for apportioning flow between room-mixing discharge 886 and short-circuit discharge 876 flows. A hood 874 has a recess through which fumes 894 flow and are exhausted by an exhaust fan 879, usually located on the top of a ventilated structure. A make-up air unit 845 replaces the exhausted air by blowing it into a supply duct 880 which vents to a combination plenum that feeds a mixed air supply register 886 and a short-circuit supply register 876. The fresh air supplied by the make-up air unit 845 is apportioned between the mixed air supply register 886 and a short-circuit supply register 876 by a damper 870 whose position is determined by a motor 865 which is in turn controlled by a controller 869.

When air is principally fed to the short-circuit supply register 876, it helps to provide most of the air that is drawn into the hood 887 along with the fumes and exhausted. Short-circuit supply of make-up air is believed by some to offer certain efficiency advantages. When the outside air is at a temperature that is within the comfort zone, or when its enthalpy is lower in the cooling season or higher in the heating season, most of the make-up air should be directed by the controller 869 into the occupied space through the mixed air supply register 886. When the outside air does not have an enthalpy that is useful for space-conditioning, the controller 869 should cause the make-up air to be vented through the short-circuit supply register 876.

Figure 15:
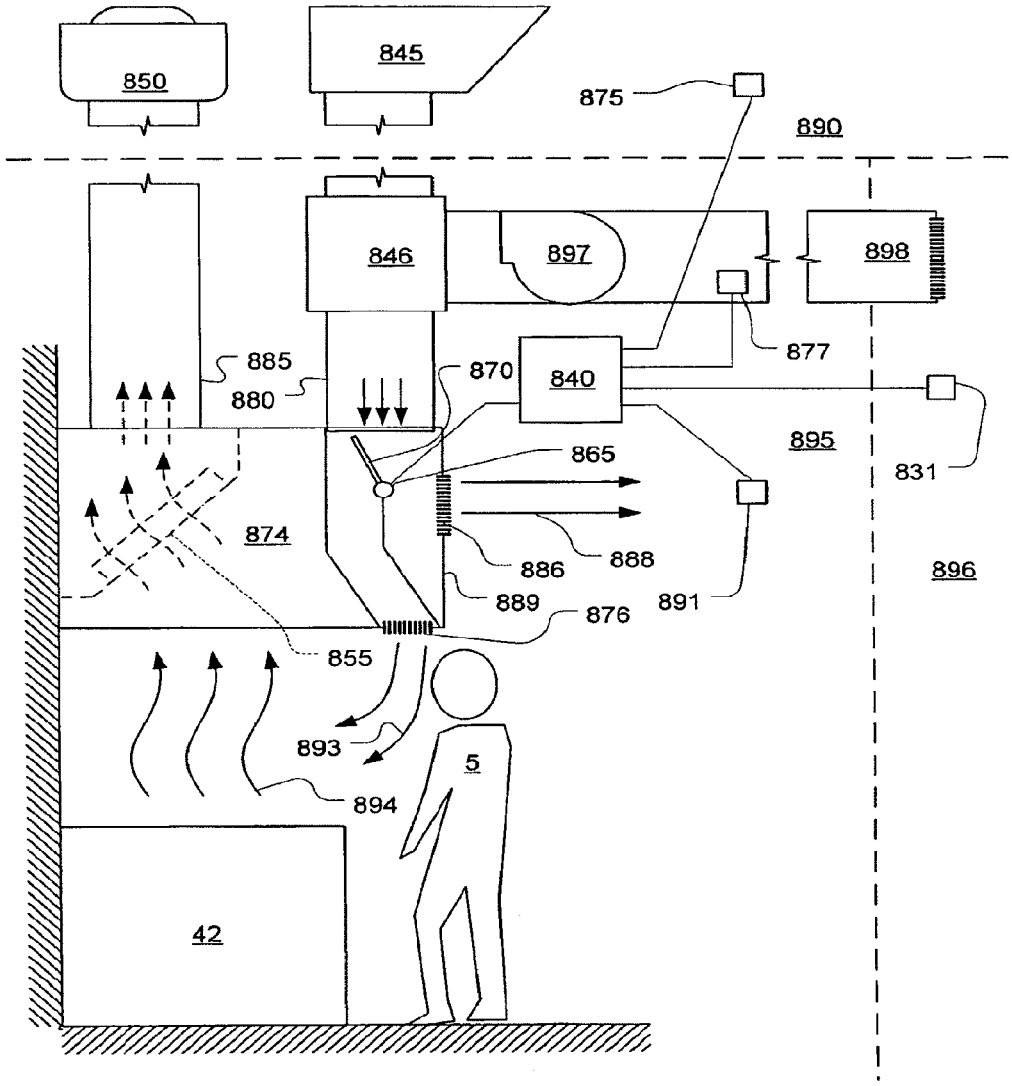
FIG. 15 illustrates a combination make-up air discharge register and hood combination with a control mechanism for apportioning flow between room-mixing discharge and a direct discharge into the exhaust zone of the hood from either outdoor air, transfer air from another conditioned space, or a mixture thereof.

FIG. 15 illustrates a combination make-up air discharge register and hood combination with a control mechanism for apportioning flow between room-mixing discharge and a direct discharge into the exhaust zone of the hood from either outdoor air, transfer air from another conditioned space, or a mixture thereof. A blower 897 brings in transfer air, which may be used to supply some of the make-up air requirement and provide a positive enthalpy contribution to the heating or cooling load. The staleness of transfer air brought into the heavily ventilated environment of a kitchen is offset by the total volume of make-up (fresh) air that is required to be delivered. Sensors on the outside 875, the occupied space 830, in the transfer air stream and/or the space from which transfer air is drawn 831 may be provided to indicate the conditions of the source air streams. A mixing box 846 may be used to provide an appropriate ratio of transfer air and fresh air. The ratio will depend on the exhaust requirements of the occupied space 896. Control of the damper 870 is as discussed with reference to FIG. 14.

Figure 16A:
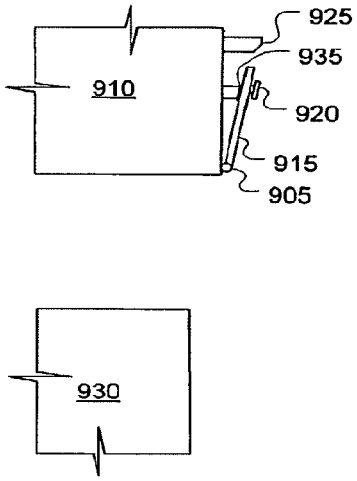
FIGS. 16A-16C illustrate drop-down skirts that can be manually swung out of the way and permitted to drop into place after a time interval.
Figure 16B:
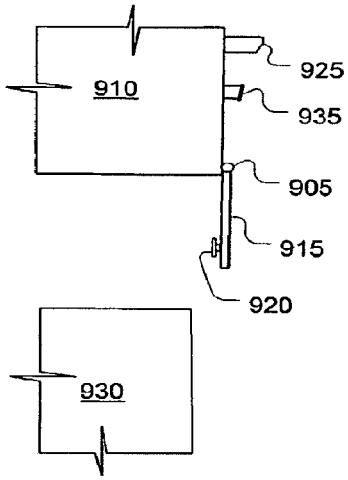
Figure 16D:
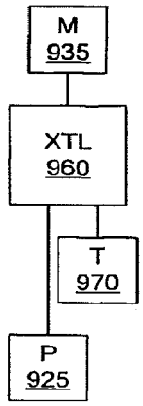
FIG. 16D illustrates components of a system with drop-down skirts that can be manually swung out of the way and permitted to drop into place after a time interval.
Figure 16C:
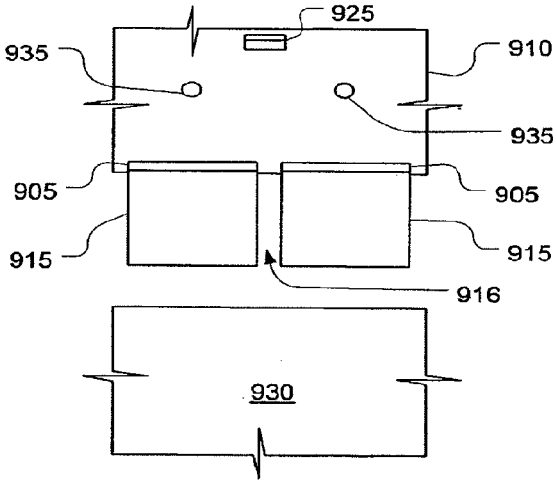

FIGS. 16A-16D illustrate drop-down skirts that can be manually swung out of the way and permitted to drop into place after the lapse of a watchdog timer. FIGS. 16A and 16B are side views of a drop-down skirt 915 that pivots from a hinge 905 from a magnetically suspended position shown in FIG. 16A to a dropped position shown in FIG. 16B. A magnetic holder/release mechanism 935, which may include an electromagnet or permanent magnet, holds the skirt panel 915 in position out of the way of an area above a fume source 930. The skirts 915 may be released after being moved up and engaged by the magnetic holder/release mechanism 935, after a period of time by a controller 960. The controller 960 may be connected to a timer 970, a proximity sensor 925, and the magnetic holder/release mechanism 935. The proximity sensor 925 may be one such as used to activate automatic doors. If nothing is within view of the proximity sensor after the lapse of a certain time, the controller may release the skirt 915. When released by the magnetic holder/release mechanism 935, the skirt 915 falls into the position of FIG. 16B to block drafts. Preferably, as shown in the front view of FIG. 16C, there are multiple skirts 915 separated by gaps 916. A passing worker may scan the area behind the skirts 915 even though they are down if the worker moves at least partly parallel to the plane of the skirts 915. In an embodiment, the magnetic holder/release mechanism 935 may combined with the controller 960, the timer 970, and the proximity sensor 925 in a unitary device.

Although in the embodiments described above and elsewhere in the specification, real-time control is described, it is recognized that some of the benefits of the invention may be achieved without real-time control. For example, the flow control devices may be set manually or periodically, but at intervals to provide the local load control without the benefit of real-time automatic control.

Note that although in the above embodiments, the discussion is primarily related to the flow of air, it is clear that principles of the invention are applicable to any fluid. Also note that instead of proximity sensors, the skirt release mechanisms described may be actuated by video cameras linked to controllers configured or trained to recognize events or scenes. The very simplest of controller configurations may be provided, where a blob larger than a particular size appears or disappears within a brief interval in a scene or a scene remains stationary for a given interval. A controller detects the latching of the skirt at step S900 and starts a watchdog timer at step S905. Control then loops through S910 and S915 as long as scene changes are detected. Again, simple blob analysis is sufficient to determine changes in a scene. Here we assume the camera is directed to view the scene in front of the hood so that if a worker is present and working, scene changes will continually be detected. If no scene changes are detected until the timer expires (step S915), then the skirt is released at step S920 and control returns to step S900 where the controller waits for the skirt to be latched. A similar control algorithm may be used to control the automatic lowering and raising of skirts in the embodiments of FIGS. 3A-5, discussed above. Instead of releasing the skirt, the skirt would be extended into a shielding position and instead of waiting for the skirt to be latched, a scene change would be detected and the skirt automatically retracted.

Figure 17:
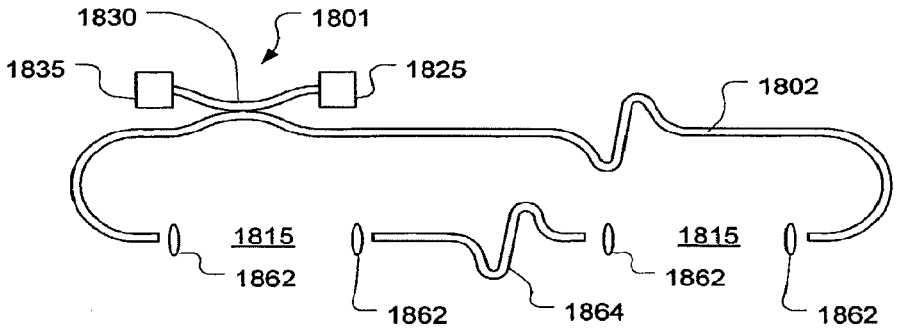
FIG. 17 illustrates a sensor configuration with a light guide having multiple sample gaps in a common light path.
Figure 18:
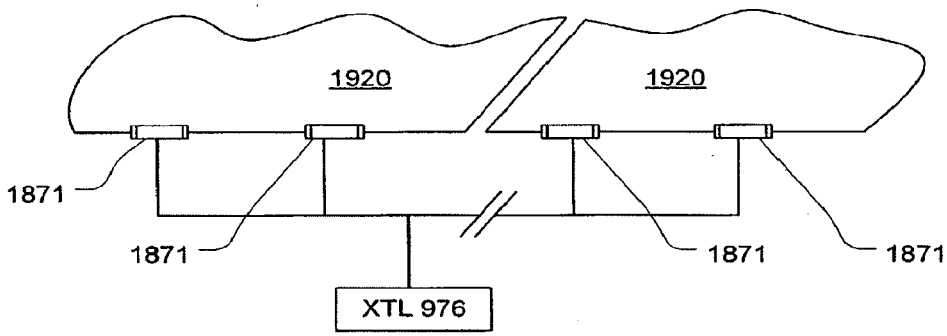
FIG. 18 shows a sensor configuration having multiple individual sample devices at a hood edge.
Figure 19:
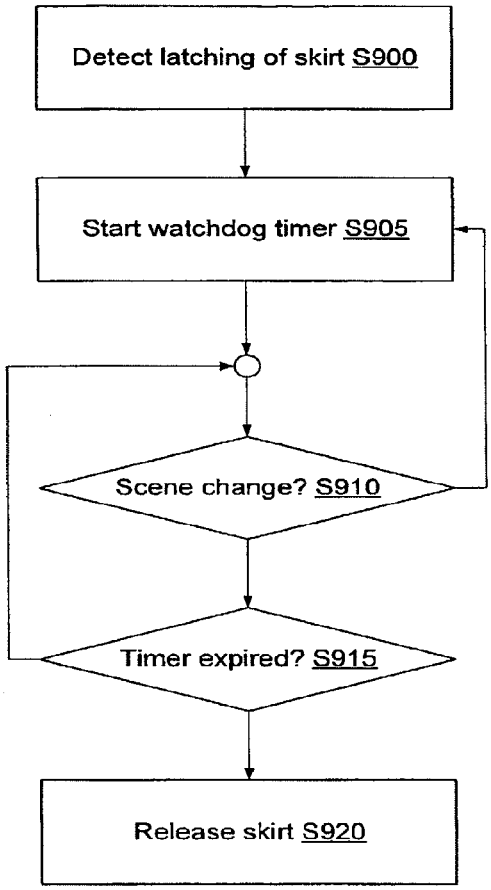
FIG. 19 is a simplified process flow diagram for latching and releasing a skirt.

Referring to FIG. 17, multiple sample gaps, such as the two indicated at 1815 may be linked together in a common light path by a light guide 1802 and a single directional coupler 1801 device or equivalent device. As in prior embodiments, a light source 1835 and detector 1825 are connected by a directional coupler 1830 with focusing optics 1862 and one or more linking light guides 1864 to provide any number of sample paths, such as paths 1815. FIG. 18 shows a hood edge 1920 with multiple individual sample devices 1871 which conform to any of the descriptions above linked to a common controller. Although parallel connections are illustrated, serial connections of either fiber or conductor may be provided depending on the configuration.

There are a variety of control techniques that may be used in connection with the interference-based sensor configurations of FIGS. 13A-C, 17, and 18. The raw signal from the sensor is the fringe pattern resulting from the interference of a reference beam and a sample beam. As the properties of the sample beam change, for example due to temperature change, vapor content, or the mix of compounds resulting from cooking or other fume-generating process, the associated speed of light through the sample path generally changes. The length of the sample path length may be chosen based on the predicted variation due to escape of exhaust fumes. Also, the configuration may be based on whether the properties will diffuse into the sample path or be transported directly by convection into the sample path. These may be matters of design choice. The signal and how it is conditioned also depends on design choice. If the sample path is chosen to be large, many interference fringes may pass over the optical detector as a single bolus of gas interacts with the detector; i.e., as the bolus moves into, or diffuses fractions thereof into, the sample path such that it changes the speed of light in the sample path. If a breach occurs, under most circumstances, the flow would be a turbulent thermal convection plume containing a mix of fumes and air from the surrounding environment producing multiple back and forth shifts in fringe pattern as the fume and ambient air boluses interact with the detector. Alternatively the process may, if the transfer is by molecular diffusion or viscous flow due to the scale of the device, the mix of fumes and air may be averaged out producing a slower response and a single back and forth fringe shift. Each fringe shift may generate multiple light and dark pulses, but again this depends on the scale of the device and the particular wavelength of light chosen.

By experimenting with the conditions of full containment and breach, one can obtain a characteristic pattern and identify it in the signal. For a grill, the thermal convection is vigorous and the properties of the fumes are such that continuous mixing with surrounding air causes a train of pulses to be generated whenever the fumes escape the hood. Thus, a simple frequency of the fringes (e.g., by converting to pulses and counting) as mentioned above may be compared to a threshold (background) level, to determine if a breach is occurring.

The invention claimed is:

1. A fume hood comprising:

a hood portion connectable to an exhaust system and having a recess and a lower edge therearound; and a jet generator located at said lower edge and configured to generate a combination of first and second jets at said lower edge thereof, said first jets being relatively horizontal in direction and forming a planar jet and said second jets being relatively vertical in direction and forming a planar jet, said first jets being directed toward said hood portion recess;

wherein the initial velocities of the horizontal jets are between 2 and 3.5 times the initial velocities of the vertical jets.

2. The fume hood as in claim 1, wherein at least one of said first and second jets are defined by a series of circular jets arranged along a line along said lower edge.

3. The fume hood of claim 1, wherein both the first and second jets are defined by a series of circular jets.

4. The fume hood of claim 1, wherein the first and second jets are defined in pairs proximal to each other.

5. The fume hood of claim 1, wherein the first and second jets emanate from a common plenum.

6. The fume hood of claim 1, wherein said first and second jets are defined by respective series of circular jets arranged along respective lines following said lower edge.

7. The fume hood of claim 1, wherein the lower edge has forward and lateral portions, and the combination of first and second jets are generated on the lower edge forward and lateral portions.

8. The fume hood of claim 1, wherein a depth of the recess is approximately equal to a span of the recess from forward to rear such that the recess has a low aspect ratio in cross-section.

9. The fume hood of claim 1, wherein the hood portion lower edge has corners at opposite horizontal ends thereof, the corners being beveled or curved in a top down view, and the first jets are directed perpendicular to said lower edge.

10. The fume hood of claim 1, wherein:

the hood portion lower edge has corners, and said first jets are directed perpendicular to said lower edge between said corners and in a direction that is diagonal with respect to said lower edge in a region proximal to said corners and thereby toward a middle of said hood portion at said corners.

11. The fume hood as in claim 1, wherein the first jets are directed directly into the hood portion recess.

12. A fume hood comprising:

a hood portion connectable to an exhaust system and having a recess and a lower edge therearound; and a jet generator located at said lower edge and configured to generate a combination of first and second jets at said lower edge thereof, said first jets being directed toward said hood portion recess and forming a planar jet and said second jets being directed downwardly and away from the recess;

wherein the initial velocities of the first jets are between 2 and 3.5 times the initial velocities of the second jets.

13. The fume hood as in claim 12, wherein at least one of said first and second jets are defined by a series of circular jets arranged along a line along said lower edge.

14. The fume hood of claim 12, wherein both the first and second jets are defined by a series of circular jets.

15. The fume hood of claim 12, wherein the first and second jets are defined in pairs proximal to each other.

16. The fume hood of claim 12, wherein the first and second jets emanate from a common plenum.

17. The fume hood of claim 12, wherein said first and second jets are defined by respective series of circular jets arranged along respective lines following said lower edge.

18. The fume hood of claim 12, wherein the lower edge has forward and lateral portions, and the combination of first and second jets are generated on the lower edge forward and lateral portions.

19. The fume hood of claim 12, wherein a depth of the recess is approximately equal to a span of the recess from forward to rear such that the recess has a low aspect ratio in cross-section.

* * * * *